US007059249B2

(12) United States Patent
Chaboki et al.

(10) Patent No.: US 7,059,249 B2
(45) Date of Patent: Jun. 13, 2006

(54) TRANSVERSE PLASMA INJECTOR IGNITOR

(75) Inventors: Amir Chaboki, Minneapolis, MN (US); Reed A. McPeak, Vadnais Heights, MN (US); Michael R. Triviski, Oakdale, MN (US); Steven R. Zelenak, Champlin, MN (US)

(73) Assignee: United Defense LP, Arlington, VA (US)

( * ) Notice: Subject to any disclaimer, the term of this patent is extended or adjusted under 35 U.S.C. 154(b) by 479 days.

(21) Appl. No.: 09/767,542

(22) Filed: Jan. 23, 2001

(65) Prior Publication Data

US 2004/0221760 A1 Nov. 11, 2004

(51) Int. Cl.
*F42L 19/12* (2006.01)

(52) U.S. Cl. ..... 102/202.8; 102/202.7; 102/202; 102/472

(58) Field of Classification Search ..... 102/472, 102/202.7, 430, 530, 202.5, 202.8, 431–433, 102/439, 467, 700; 89/8, 7; 86/1.1
See application file for complete search history.

(56) References Cited

U.S. PATENT DOCUMENTS

| | | | | |
|---|---|---|---|---|
| 4,494,043 A | | 1/1985 | Stallings et al. | 315/111.4 |
| 4,698,532 A | * | 10/1987 | Ross | 89/8 |
| 4,711,154 A | | 12/1987 | Chryssomallis et al. | 89/7 |
| 4,835,341 A | | 5/1989 | Katz et al. | 174/142 |
| 4,889,605 A | | 12/1989 | Asmus et al. | 204/157.44 |
| 4,895,062 A | | 1/1990 | Chryssomallis | 89/7 |
| 5,072,647 A | | 12/1991 | Goldstein et al. | 89/8 |
| 5,094,141 A | | 3/1992 | Zwingel et al. | 89/8 |
| 5,171,932 A | | 12/1992 | McElroy | 89/8 |
| 5,225,624 A | | 7/1993 | Schneider et al. | 89/8 |
| 5,231,242 A | | 7/1993 | Chryssomallis | 89/8 |
| 5,233,903 A | | 8/1993 | Saphier et al. | 89/8 |
| 5,287,791 A | | 2/1994 | Chaboki et al. | 89/8 |
| 5,355,764 A | | 10/1994 | Marinos et al. | 89/8 |
| 5,425,570 A | | 6/1995 | Wilkinson | 299/14 |
| 5,431,105 A | | 7/1995 | Wilkinson | 102/430 |
| 5,444,208 A | | 8/1995 | Mortensen | 219/121.48 |
| 5,503,058 A | | 4/1996 | Marinos | 89/8 |
| 5,503,081 A | | 4/1996 | Lindblom et al. | 102/472 |
| 5,515,765 A | | 5/1996 | Wilkinson | 86/1.1 |
| 5,610,365 A | * | 3/1997 | Thiesen | 102/431 |

(Continued)

FOREIGN PATENT DOCUMENTS

| | | |
|---|---|---|
| DE | 19629515 A1 | 1/1998 |
| EP | 0220556 | 10/1986 |
| EP | 0338458 | 4/1989 |
| EP | 0382000 | 1/1990 |

OTHER PUBLICATIONS

Recent Advances in Electrothermal–Chemical Gun Propulsion at United Defense, L.P., A. Chaboki, S. Zelenak, B. Isle.

*Primary Examiner*—Michael J. Carone
*Assistant Examiner*—James S. Bergin
(74) *Attorney, Agent, or Firm*—Patterson, Thuente, Skaar & Christensen, P.A.

(57) ABSTRACT

A plasma injector for use in munitions having a central axis. The plasma injector has a stub case, a tube, an anode, a cathode, and a conductive wire. The tube has a first end, a second end, and a central bore extending therethrough. The tube has at least one aperture that is operably connected to the central bore. The tube is attached to the stub case substantially transverse to the central axis. The anode is positioned proximate the first end. The cathode is positioned proximate the second end. The conductive wire extends through the central bore between the anode and the cathode and operably connects the anode and the cathode.

23 Claims, 6 Drawing Sheets

U.S. PATENT DOCUMENTS 5,675,115 A 10/1997 Hershkowitz et al. ..... 102/202
5,688,416 A 11/1997 Johnson ..... 219/121.148
5,767,439 A 6/1998 Lindblom et al. ..... 102/472
5,830,377 A 11/1998 Johnson ..... 219/121.36
5,880,427 A 3/1999 Johnson ..... 219/121.52
5,886,290 A 3/1999 Lindblom et al. ..... 102/530
5,898,124 A 4/1999 Krumm et al. ..... 102/430
5,945,623 A 8/1999 Goldstein et al. ..... 89/8
5,988,070 A 11/1999 Krumm et al. ..... 102/430
6,237,494 B1 * 5/2001 Brunet et al. ..... 102/202.7

* cited by examiner

TRANSVERSE PLASMA INJECTOR IGNITOR

FIELD OF THE INVENTION

The present invention generally relates to a plasma injector for a gun system. More particularly, the present invention relates to a stub case integrated transversely mounted plasma injector.

BACKGROUND OF THE INVENTION

Currently, most large size munitions use chemical compositions to initiate the ignition of propellant in munitions. Chemical energy igniters utilize convective heat transfer to ignite propellants and produce relatively heavy constituent gases which travel slower and cool rapidly compared to plasmas. Drawbacks associated with chemical ignitors include composition instability, and ignition speed.

In an effort to overcome the drawbacks associated with chemical ignitors, a variety of electrothermal-chemical (ETC) ignition systems have been developed. While the electrothermal ignition systems have the potential to provide more consistent and more uniform propellant ignition, these systems require large electrical energy storage devices to power their operation. As such, electrothermal ignition systems are typically used only for high caliber, high velocity gas systems.

Plasma is an electrically conducting gas composed of ions, electrons, and neutral particles sufficient to support an electric field. Examples of plasma include a lighting bolt, a spark plug discharge, and a spark from a shorted electrical circuit. The core temperate of plasma is extremely high, 10,000–20,000 degrees Kelvin. High temperature plasma is a very effective radiative heat transfer device since radiation heat transfers as a function of the temperature raised to the 4th power. U.S. Pat. Nos. 4,494,043, 4,835,341, 4,889,605 and 5,425,570 show examples of plasma discharge systems for applications other than ETC ignition systems.

In guns that use an ETC ignition system, plasma is created between electrodes of injector devices to ignite propellants in a very short duration time period (0.5–3 milliseconds). The effluent from these plasma devices consists of high temperature, low molecular weight gases traveling at very high velocities. These hot gases are extremely effective at permeating and igniting highly packed propellant charges that can be difficult or impossible to ignite with traditional chemical igniters. For a more detailed background on ETC ignition systems, reference is made to Chaboki et al., *Recent Advances in Electrothermal-Chemical Gun Propulsion at United Defense, L.P.*(19__).

To provide uniform ignition of the propellant, conventional plasma ETC ignition systems are oriented along a central axis of the munition. U.S. Pat. Nos. 5,072,647, 5,231,242, 5,287,791, 5,675,115 and 5,945,623 show various conventional ETC ignition systems having a single ignition tube aligned along the central axis of the combustion chamber of the munition. U.S. Pat. Nos. 5,431,105, 5,425,570, 5,503,058, and 5,515,765 show various ETC ignition systems having an outer ignition tube that is aligned with the central axis of the munition and surrounds the combustion chamber. U.S. Pat. Nos. 5,503,081, 5,767,439 and 5,886,290 describe an annular ETC ignition system that having embodiments that show a continuous central ignition tube, an annular outer ignition tube or a segmented central ignition tube, all of which are aligned parallel with the central axis of the munition.

Other more complicated arrangements for ETC ignition systems have also been developed. U.S. Pat. No. 5,233,903 shows the use of multiple staged plasma ETC ignition systems oriented at an oblique angle to the barrel of the gun. U.S. Pat. Nos. 5,171,932, 5,355,764, 5,444,208 and 6,119,599 describe different arrangements for using multiple plasma ignition systems oriented parallel to the central axis of the munition in either a collinear manner along the central axis or in a distributed in a circle around the central axis to energize a propellant. U.S. Pat. Nos. 5,688,416, 5,830,377 and 5,880,427 describe a tapered plasma injector that is aligned with the central axis of the munition and includes an adjustable magnetic field coil to enhance the ignition of the propellant.

One significant limitation on the use of all of these plasma ETC ignition systems is that there is a trade off between lengthening the plasma injector to increase the impedance, thereby allowing higher current to be used for quicker ignition, and providing a balanced plasma discharge, and lengthening a tail-like guide intrusion of the munition to improve the flight characteristics of the munition. This trade off is necessitated because both the plasma injector and the guide intrusion are located along the central axis within the combustion chamber.

Some plasma ETC ignition systems have been developed for munitions that do not include tail-like guide intrusions in the combustion chamber. Typically, these types of plasma ETC ignitions systems have a separate chamber for the ignition system and for an oxidizer material or propellant material. U.S. Pat. Nos. 4,711,154 and 4,895,062 describe plasma ETC ignition systems in which an oxidizer chamber is positioned between the plasma ignition system and propellant and a flat-ended munition.

U.S. Pat. Nos. 5,898,124 and 5,988,070 describe a plasma ETC ignition system in which the oxidizer chamber is positioned between the plasma ignition system and the propellant with a flat-ended munition located forward of the propellant chamber that is separate from the oxidized chamber. In U.S. Pat. No. 5,225,624, a stageable plasma injector is positioned in a chamber forming a plasma incubation region that exhaust upon ignition into a propellant chamber to propel a flat-ended munition. In each of these cases, the plasma igniter is oriented along the central axis of the munition and extends into the relevant chamber that is to be initially ignited.

Although significant advances have been made with respect to the development of plasma ETC ignition systems for guns, it would be desirable to provide an improved plasma injector ignitor that is more efficient for igniting propellants for munitions, and particularly one that is better suited for use with larger caliber munitions having tail-like guide intrusions that extend into the propellant chamber.

SUMMARY OF THE INVENTION

The present invention is a plasma injector assembly for use in munitions having a central axis. The plasma injector assembly includes a stub case, a tube, an anode, a cathode, and a conductive wire. The tube has a first end, a second end, and a central bore that extends therethrough. The tube has at least one aperture that is operably connected to the central bore. The tube is mounted in the stub case substantially transverse to the central axis. The anode is positioned proximate the first end. The cathode is positioned proximate the second end. The conductive wire extends through the central bore between the anode and the cathode and operably connects the anode and the cathode.

The plasma injector assembly of the present invention occupies a relatively small portion of the length of the munitions. The plasma injector of the present invention thereby enables munitions with longer guide mechanisms to be used, which enhances the ability to accurately direct the munitions towards a desired target.

DETAILED DESCRIPTION OF PREFERRED EMBODIMENTS

Figure 1:
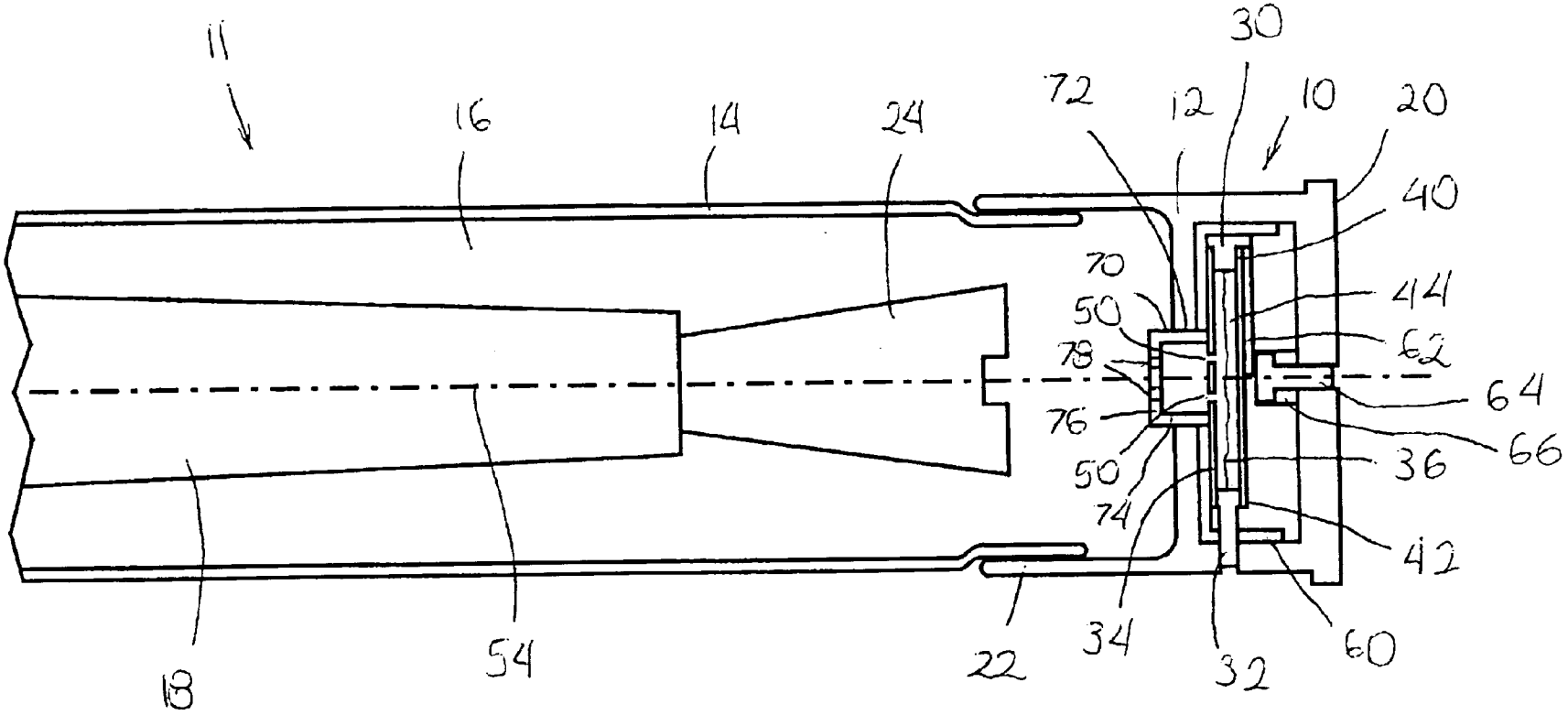
FIG. 1 is a sectional view illustrating the use of a plasma injector according to the present invention in a stub case.

The present invention includes a plasma injector, as most clearly illustrated at 10 in FIG. 1. The plasma injector 10 is preferably used with a munition 11 that includes a stub case 12, a casing 14, a propellant 16 and a projectile 18. The plasma injector 10 of the present invention is oriented substantially transverse to a central axis 54 of the munition 11 and is contained substantially within the stub case 12.

The plasma injector 10 permits the projectile 18 to penetrate more deeply into the stub case 12 than is possible using prior art plasma injectors. The greater penetration allows for an increased length to diameter ratio, which enables the flight characteristics and terminal effectiveness of the munitions to be enhanced and minimizes the overall length of the munition.

The plasma injector 10 also provides nearly simultaneous and uniform ignition of the propellant 16. The plasma injector 10 also provides more stable ignition system than the chemical ignitors that are currently used.

The plasma injector 10 of the present invention provides a plasma arc length that is greater than in the prior art devices and thereby achieves a sufficiently high impedance to more efficiently transfer electrical energy than the prior art plasma injectors.

Still other benefits of the plasma injector 10 of the present invention include reduced parasitic mass of injector components in the charge portion of the munition and decreased material that must be discarded after the munition has been discharged.

The plasma injector 10 of the present invention is located substantially within the stub case 12 and preferably adjacent a lower surface 20 of the stub case 12 such that the plasma injector 10 has a height that is lower than a height of an annular wall 22 that extends from the lower surface 20. Alternatively, the plasma injector 10 is integrated in the breech of an indirect fire gun using caseless ammunition such as a modular artillery charge.

The orientation of the plasma injector 10 is preferably referred to as being located within a planar depth that is oriented substantially transverse to the central axis 54. As used herein the term planar depth encompasses a generally planar surface that has a thickness. The thickness of the planar depth not only takes into account the thickness of a channel in which the plasma is generated but also takes into account that the path of the channel may deviate from being substantially transverse to the central axis at certain regions of the channel.

The plasma injector 10 occupies less than 12 percent of the length of the munition 11. Preferably, the plasma injector 10 occupies less than 10 percent of the length of the munition 11. Optimally, the plasma injector 10 occupies less than 8 percent of the length of the munition 11. The plasma injector 10 thereby enables the guide mechanism 24 of the projectile 18 to extend into the casing 14 to a location that is proximate the stub case 12 and potentially at least partially into the stub case 12. The long guide mechanism 24 thereby permitted by the plasma injector 10 enhances the flight characteristics exhibited by the projectile 18.

The guide mechanism 24 extends more than 50 percent through the length of the enclosed region 16. Preferably, the guide mechanism 24 extends more than 80 percent through the length of the enclosed region 16. Optimally, the guide mechanism 24 extends more than 90 percent through the length of the enclosed region 16.

The plasma injector 10 generally includes an anode 30, a cathode 32, and a tube 34. The anode 30 is placed proximate a first end 40 of the tube 34. The cathode 32 is placed proximate a second end 42 of the tube 34. The anode 30 and the cathode 32 thereby substantially seal the ends 40, 42 of the tube 34.

The tube 34 has a central bore 44 that extends from the first end 40 to the second end 42. The tube 34 has at least one aperture 50 that extends therethrough. Preferably, the tube 34 has up to ten apertures 50 formed therein. The apertures 50 permit the plasma to pass from the central bore 44 into a region that surrounds the plasma injector 10.

The plasma is vented assymetrically from a middle section of the tube 34. Venting the plasma in this manner promotes uniform ignition and combustion of the propellant 16. This type of plasma venting is particularly suited for advanced propellant configuration in which ullage volume will exist along the projectile afterbody.

The tube 34 is preferably fabricated from an insulating material such as a fiber-wound composite. Fabricating the tube 34 from a fiber wound composite provides the tube 34 with sufficient structural rigidity to withstand the plasma pressurization and the forces that are typically encountered during the firing procedure.

To enhance the ability of the plasma injector 10 to reproducibly produce plasma, the plasma injector 10 preferably includes a conductive wire 36 that extends between the anode 30 and the cathode 32. When the plasma injector 10 is activated, the electrical current flowing through the conductive wire 36 causes the electrical wire 36 to vaporize and promote the formation of a conductive gas between the electrodes.

The tube 34 is mounted in a recess 52 formed in a filler material 60 so that the tube 34 is substantially perpendicular to the central axis 54. The tube 34 preferably seats substantially within the recess 52 so that the tube 34 is oriented substantially perpendicular to a central axis 54 of the munition 11.

The filler material 60 substantially fills the portions of the stub case 12 that surround the plasma injector 10 to thereby prevent the plasma injector from moving in the base 20. The filler material 60 is preferably fabricated in two components. The filler material 60 is preferably manufactured from a laminated composite. One suitable material for use in manufacturing the filler material 60 is sold under the designation G10.

The plasma ignitor 10 also preferably includes a cylindrically shaped vent component 70 that extends through an aperture 72 in the stub case 12. The vent component 70 preferably has a cylindrical side wall 74 and a base wall 76 that substantially encloses an end of the vent component 70 except for a plurality of apertures 78 formed therein. The vent component 70 is preferably fabricated from a non-metallic material such as a fiber wound composite, ceramic or high-temperature plastic.

The tube 34 is preferably connected through the stub case 12 to a power source that is capable of causing the production of plasma when current flows form the anode 30 to the cathode 32. One suitable power source for use with the present invention is a capacitor that stores electrical energy up to 600 kilojoules and preferably between 200 kilojoules and 300 kilojoules. The anode 30 preferably extends through the lower surface of the base 20 and is positioned along the central axis 54 of the base 20. To facilitate attachment of the anode 30 to the power source, the plasma injector 10 has a transfer lead 62 and a connector pin 64. The conductive components of the plasma injector 10 are preferably welded or braised together to enhance the flow of the electrical current therethrough. To insulate the connector pin 64 from the other portions of the plasma injector 10, an insulating ring 66 is placed at least partially around the connector pin 64.

The cathode 32 is preferably connected through the stub case 12 to a ground source. Preferably, the cathode 32 extends through a side surface of the base 20.

The plasma injector 10 operates in conjunction with the propellant 16 to form what is commonly called an electro-thermal chemical system. One application for which the plasma injector 10 of the present invention is particularly suited is propulsion of a kinetic energy projectile from a gun such as is used in many tanks. Examples of solid propellants that are suitable for use in the present application a nitroamine-based propellants such as are available under the designation RDX. Another suitable propellant for use in the present invention is co-layer plate propellant such as is disclosed in U.S. Pat. No. 6,167,810, which is assigned to the assignee of the present application.

Using the plasma injector 10 with the propellant plates disclosed in the preceding application because the plasma injector 10 causes plasma to flow in a generally axial direction such that the plasma is directed into the ullage volume between the plates. The plasma injector 10 of the present invention thereby produces superior propellant ignition results when compared to the prior art plasma injectors in which the plasma generally flows in a radial direction.

In operation, the munition 11 containing the plasma injector 10 is placed in a launching device such that the plasma injector 10 is operably attached to the power source. Thereafter, the power supply is discharged, which causes current to flow from the anode 30 to the cathode 32 through the tube 34. The current thereby causes the conductive wire 36 to be vaporized and also facilitates plasma to be generated. As the apertures 50 provide the only manner of egress of the plasma to pass out of the tube 34, the plasma flows out of the tube 34 through the apertures 50 and through the vent component 70.

Plasma passing out of the tube 34 ignites the propellant 16. Ignition of the propellant 16 thereby causes the projectile 18 to be propelled out of the launching device.

The plasma injector 10 of the present invention provides uniform and precise ignition with a delay of approximately 1–2 milliseconds compared to chemical ignition systems that exhibit a delay of approximately 6–8 milliseconds or more.

Figure 2:
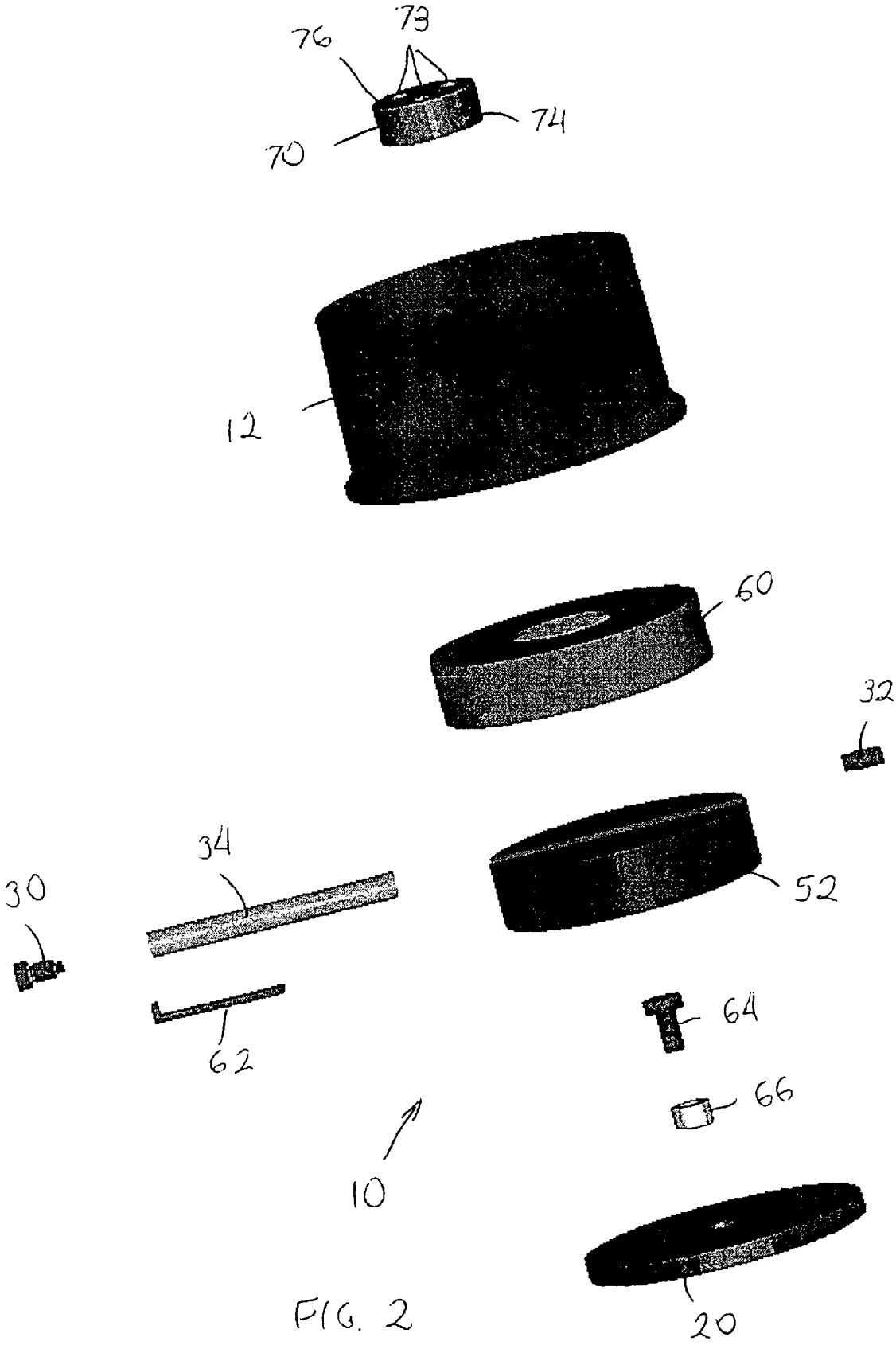
FIG. 2 is an exploded perspective view of the plasma injector and the stub case.
Figure 3:
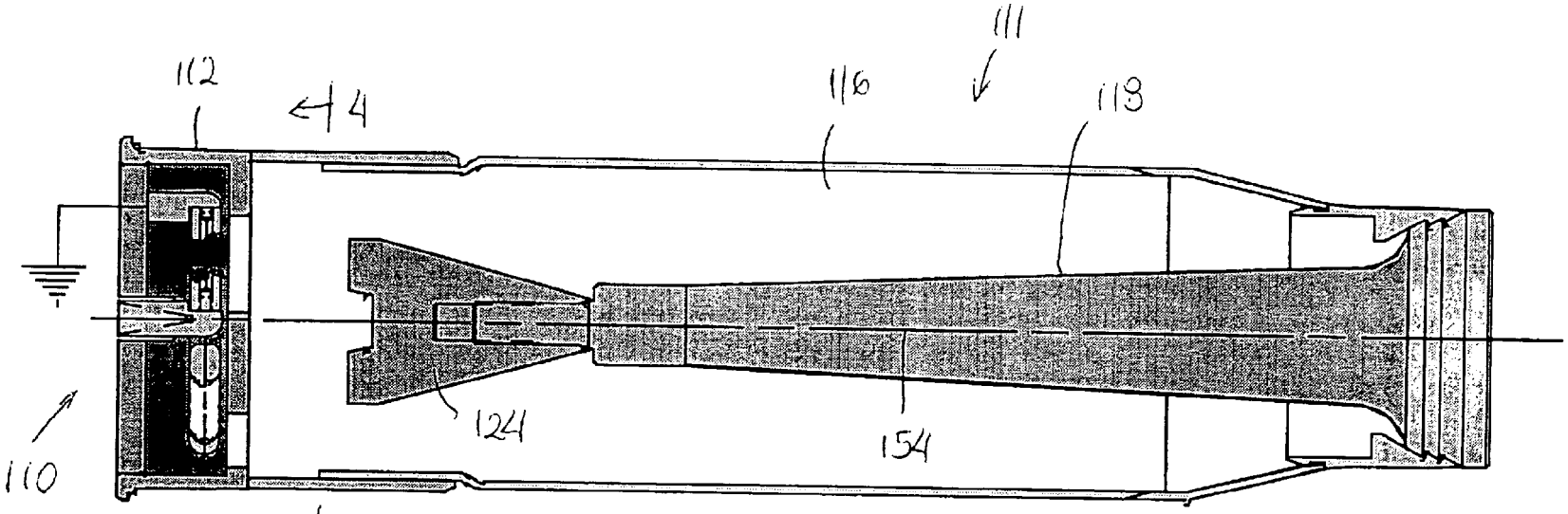
FIG. 3 is a side sectional view of an alternative configuration of the plasma injector integrated into the stub case of a munition.
Figure 4:
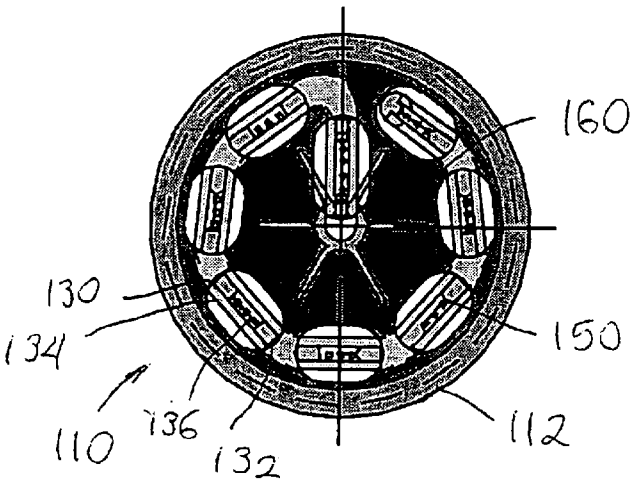
FIG. 4 is a top sectional view of the plasma injector taken along a line 4—4 in FIG. 3.

In an alternative embodiment of the present invention, several plasma injectors 110 are connected in series, as most clearly illustrated in FIGS. 3 and 4. Connecting the plasma injectors 110 in series further increases the arc length when compared to the embodiment illustrated in FIGS. 1 and 2 and thereby leads to increased impedance allowing for higher transfer of the stored electrical energy. The plasma injector 110 of this embodiment exhibits efficient dissipation of electrical energy while only occupying a relatively small portion of the interior of the munition.

Each of the plasma injector modules 110 includes an anode 130, a cathode 132, a tube 134, and a conductive wire 136. Each of the tubes 134 has at least one aperture 150 formed therein. The plasma injector modules 110 are preferably mounted in a filler material 160 that substantially occupies the portions of the stub case 112 outside of the plasma injectors 110. Similar to the embodiment illustrated in FIGS. 1–2, the filler material 160 is preferably fabricated from a laminated composite such as G10.

Figure 5:
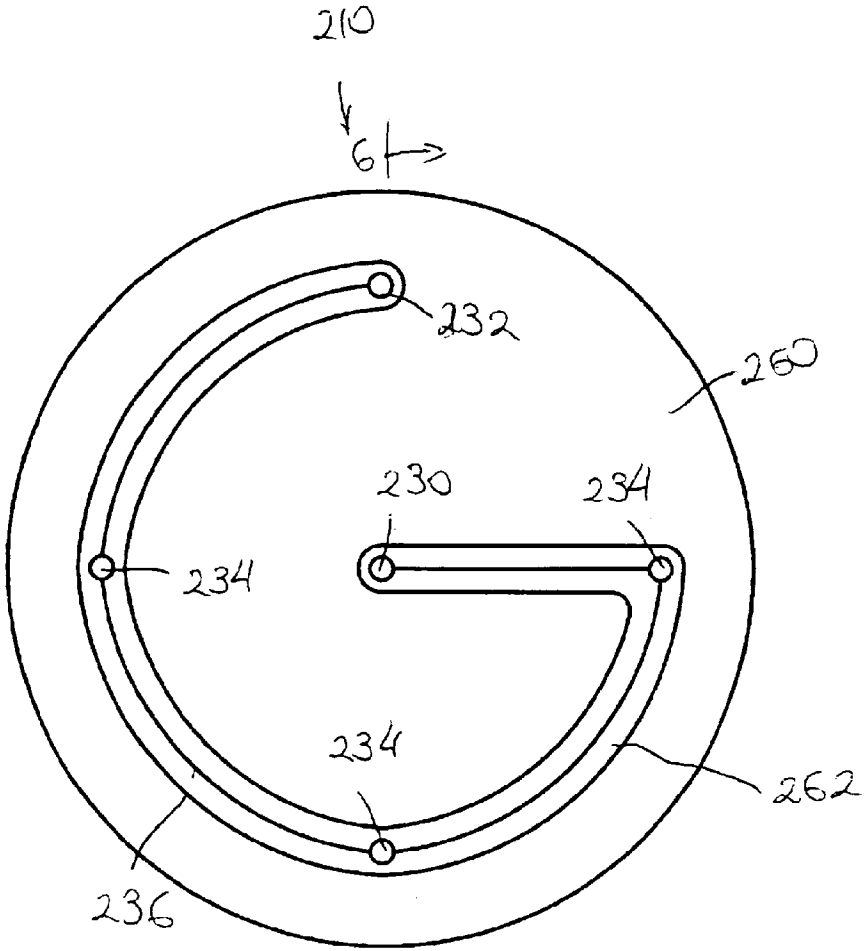
FIG. 5 is a top view of a channel configuration in a stub case.
Figure 6:
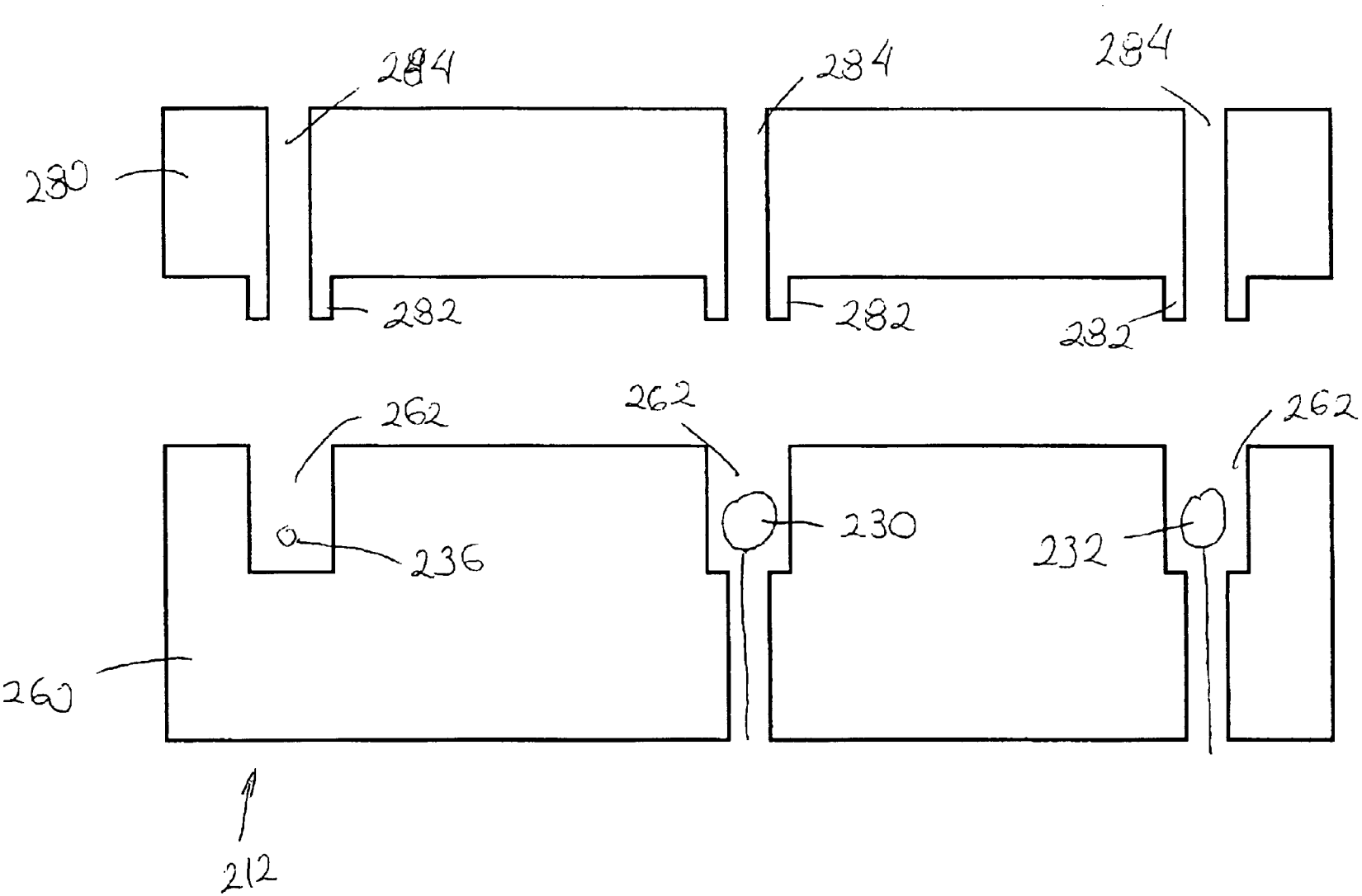
FIG. 6 is a sectional view of the base taken along a line 6—6 in FIG. 5.

In another preferred embodiment of the present invention, the plasma injector 210 is integrated into the stub case 212 of the munition, as most clearly illustrated in FIGS. 5 and 6. In this embodiment, the stub case 212 includes a pad 260 that is formed from an insulating material. The pad is preferably fabricated from a laminated composite. The laminated composite is preferably reinforced with fiberglass. One suitable material for fabricating the pad is sold under the designation G10.

The pad 260 has a channel 262 formed therein, as most clearly illustrated in FIG. 6. The channel 262 preferably has a width and depth of approximately 0.25 inches.

The anode 230 and the cathode 232 are both mounted in the channel 262. Similar to the other embodiments, the plasma injector 210 of this embodiment preferably has a conductive wire 236 that operably connects the anode 230 and the cathode 232.

Depending on the length of the channel, additional electrodes 234 may be placed at intermediate locations within the channel 262. The intermediate electrodes 234 promote arc stability and decrease the voltage drop along the arc length.

The plasma injector 210 also includes a top portion 280 that seats over the pad 260. The top portion 280 has a lip 282 extending therefrom that is oriented to conform to a location of the channel 262 in the pad 260. The lip 282 thereby partially extends into the channel 262 to seal the channel 262. The top portion 280 also has a plurality of apertures 284 formed therein. The apertures 284 are preferably oriented directly above the channel 262 such that plasma generated in the channel 262 is directed through the apertures 284 and into a portion of the, munition where the propellant is located so that the plasma can thereby ignite the propellant.

Figure 7:
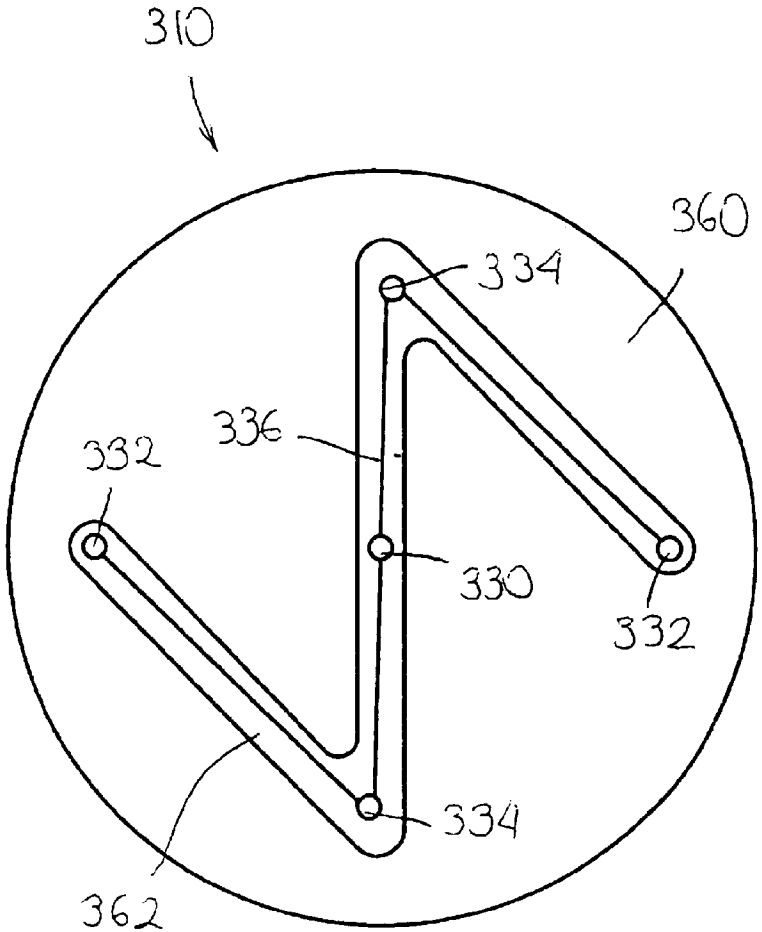
FIG. 7 is a top view of an alternative channel configuration in the stub case.

In another alternative embodiment, the plasma injector 310 includes filler 360 with a Z-shaped channel 362 formed therein, as most clearly illustrated in FIG. 7. In this configuration the anode 330 is positioned at a central location on the center leg 336. Side legs 338 extend from opposite ends of the center leg 236. The cathodes 332 are located at ends of the side legs 338 that are opposite the center leg 336.

The anode 330 and each of the cathodes 332 are preferably connected with a conductive wire 336. To facilitate arc stability and decrease voltage drop along the arc length, intermediate electrodes 334 are included in between the anode 330 and each of the cathodes 332.

Figure 8:
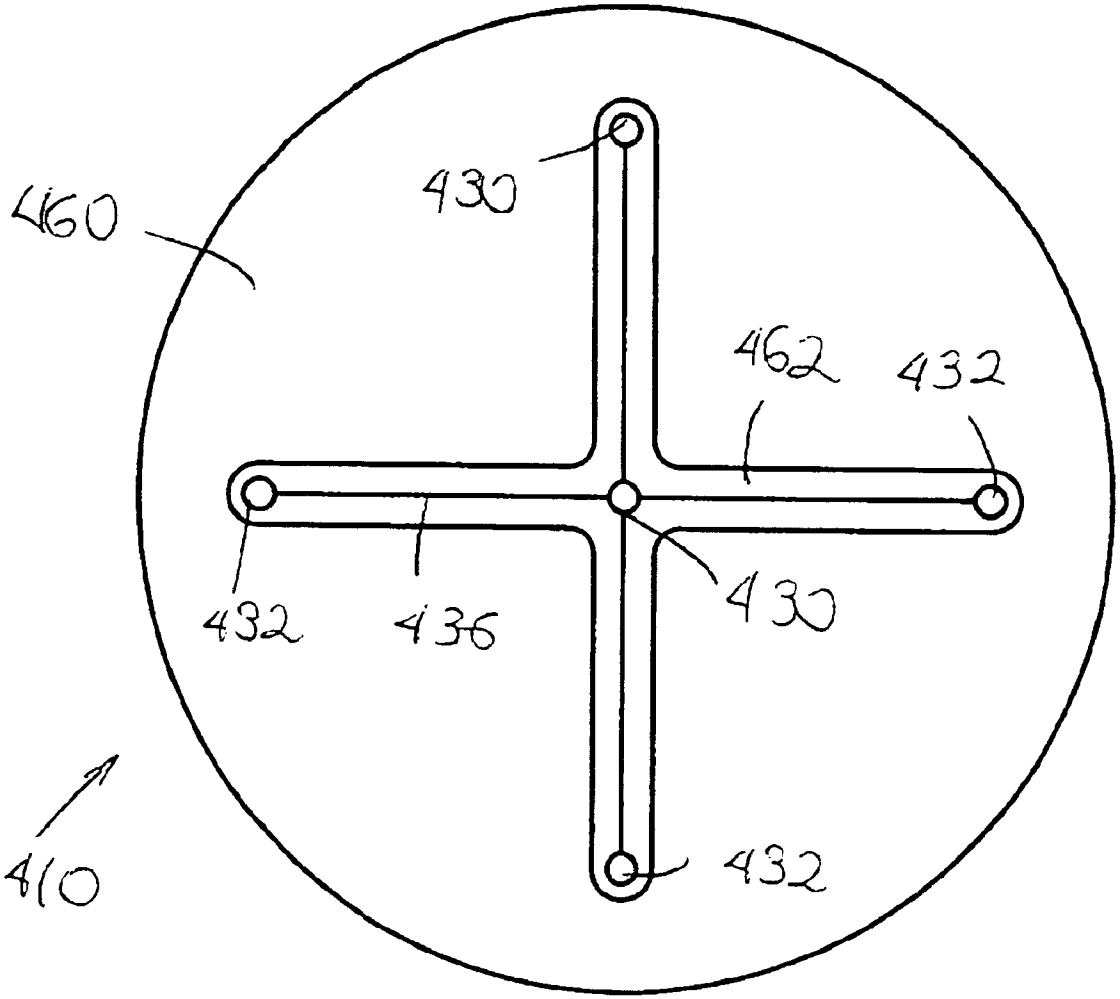
FIG. 8 is a top view of another alternative channel configuration in the stub case.

In still another embodiment, the plasma injector 410 has the filler 460 with an X-shaped channel 462 formed therein, as most clearly illustrated in FIG. 8. In this configuration the anode 430 is positioned along a central axis of the stub case 412. Side legs 438 extend in four directions from the anode 430. The cathodes 432 are located at ends of the side legs 438 that are opposite the anode 430.

The anode 430 and each of the cathodes 432 are preferably connected with a conductive wire 436. To facilitate arc stability and decrease voltage drop along the arc length, intermediate electrodes (not shown) may be included in between the anode 430 and each of the cathodes 432.

It is contemplated that features disclosed in this application, as well as those described in the above applications incorporated by reference, can be mixed and matched to suit particular circumstances. Various other modifications and changes will be apparent to those of ordinary skill.

What is claimed is:

1. A plasma injector assembly for use in a munition having a central axis, the plasma injector assembly comprising:

a stub case for attachment to the munition along the central axis;

an anode positioned in the stub case;

a cathode positioned in the stub case, wherein the anode and the cathode are located at opposite ends of a plasma creation region, wherein the plasma creation region is aligned along a planar depth that is substantially transverse to the central axis; and a vent assembly disposed between the plasma creation region and a forwardly disposed propellant region; wherein the vent assembly channels plasma into said forwardly disposed propellant region.

2. The plasma injector assembly of claim 1, and further comprising a conductive wire that interconnects the anode and the cathode.

3. The plasma injector assembly of claim 1, wherein the plasma injector assembly has a tube with a first end and a second end, wherein the anode is placed in the first end, wherein the cathode is placed in the second end, and wherein the tube has at least one aperture formed therein such that a region inside the tube is in communication with the vent assembly.

4. The plasma injector assembly of claim 3, wherein the plasma injector assembly substantially ignites the propellant within about 1–2 milliseconds.

5. The plasma injector assembly of claim 1, wherein the plasma injector assembly produces plasma that is directed into the propellant region by a plurality of apertures in the vent assembly.

6. A plasma injector assembly for use in a munition having a central axis, the plasma injector comprising:

a stub case for attachment to the munition along the central axis;

a tube having a first end and a second end, wherein the tube has a central bore extending therethrough, wherein the tube has at least one aperture that is operably connected to the central bore, and wherein the tube is mounted to the stub case in an orientation that is substantially transverse to the central axis;

an anode positioned proximate the first end;

a cathode positioned proximate the second end;

a conductive wire extending through the central bore between the anode and the cathode and operably connecting the anode and the cathode; and a vent assembly having an aft end and a forward end wherein the aft end is in communication with the tube and a forward end is in communication with a fowardly disposed propellant.

7. The plasma injector assembly of claim 6, wherein the plasma injector assembly substantially ignites the propellant within about 1–2 milliseconds.

8. The plasma injector assembly of claim 6, wherein the vent assembly directs plasma into the munition in a plurality of directions so as to avoid a projectile guide mechanism.

9. A munition comprising:

a stub case;

a casing attached to the stub case, wherein the stub case and the casing are oriented along a central axis;

a projectile attached to the casing opposite the stub case, wherein the stub case, casing and the projectile define a substantially enclosed region;

a propellant substantially filling the substantially enclosed region;

a plasma injector mounted substantially within the stub case in communication with the propellant, wherein the plasma injector has an anode and a cathode that are aligned along a planar depth that is substantially transverse to the central axis; and a filler material having a channel formed therein, wherein the channel is adapted to receive the anode and the cathode, and wherein the filler material has at least one aperture that extends through the filler material to the substantially enclosed region.

10. The munition of claim 9, wherein the plasma injector extends into the munition less than 12 percent of a length of the munition.

11. The munition of claim 9, and further comprising a conductive wire that interconnects the anode and the cathode.

12. The munition of claim 9, wherein the plasma injector has a tube with a first end and a second end, wherein the anode is placed in the first end, wherein the cathode is placed in the second end, and wherein the tube has at least one aperture formed therein such that a region inside the tube is in communication with the propellant.

13. A munition comprising:

a stub case;

a casing attached to the stub case, wherein the stub case and the casing are oriented along a central axis;

a projectile attached to the casing opposite the stub case, wherein the stub case, casing and the projectile define a substantially enclosed region, wherein the projectile has a guide portion that extends into the substantially enclosed region for a length that is at least one-half a length of the substantially enclosed region along the central axis, wherein the guide portion enhances the ability to accurately propel the projectile;

a propellant substantially filling the substantially enclosed region; and a plasma injector mounted substantially within the stub case in communication with a vent assembly, said vent assembly to channel a plasma into the propellant, wherein the plasma injector has an anode and a cathode wherein said anode and said cathode are aligned along a single planar depth that is substantially transverse to the central axis.

14. The munition of claim 13, wherein the plasma injector extends into the munition less than 12 percent of a length of the munition.

15. The munition of claim 13, wherein the guide portion extends more than 80 percent into a length of the substantially enclosed region.

16. The munition of claim 13, wherein the plasma injector has a tube with a first end and a second end, wherein the anode is placed in the first end, wherein the cathode is placed in the second end, and wherein the tube has at least one aperture formed therein such that a region inside the tube is in communication with the propellant.

17. A munition comprising:

a stub case;

a casing attached to the stub case, wherein the stub case and the casing are oriented along a central axis;

a projectile attached to the casing opposite the stub case, wherein the stub case, casing and the projectile define a substantially enclosed region;

a propellant substantially filling the substantially enclosed region; and a plurality of plasma injectors mounted substantially within the stub case in communication with the propellant through a vent assembly, wherein each of the plasma injectors in the plurality of plasma injectors has an anode and a cathode that are aligned along a planar depth that is substantially transverse to the central axis.

18. The munition of claim 17, wherein the plasma injectors in the plurality of plasma injectors are connected in series.

19. The munition of claim 17, wherein the plasma injectors in the plurality of plasma injectors are connected in parallel.

20. The munition of claim 17, wherein each of the plasma injectors in the plurality of plasma injectors has a conductive wire that interconnects the anode and the cathode.

21. The munition of claim 17, wherein each of the plasma injectors in the plurality of plasma injectors has a tube with a first end and a second end, wherein the anode is placed in the first end, wherein the cathode is placed in the second end, and wherein the tube has at least one aperture formed therein such that a region inside the tube is in communication with the propellant.

22. The munition of claim 17, wherein each of the plasma ignitors in the plurality of plasma injectors has a filler material having a channel formed therein, wherein the channel is adapted to receive the anode and the cathode, and wherein the filler material has at least one aperture that extends through the filler material to the substantially enclosed region.

23. The munition of claim 22, wherein each of the plasma ignitors in the plurality of plasma injectors has an intermediate electrode between the anode and the cathode.

* * * * *